US005636012A

United States Patent [19]

Uneme et al.

[11] Patent Number: 5,636,012

[45] Date of Patent: Jun. 3, 1997

[54] TONER IMAGE FIXING DEVICE

[75] Inventors: Kazuhiko Uneme; Masashi Saito; Kazuo Yasuda, all of Hachioji, Japan

[73] Assignee: Konica Corporation, Japan

[21] Appl. No.: 568,676

[22] Filed: Dec. 7, 1995

[30] Foreign Application Priority Data

Dec. 13, 1994 [JP] Japan ..... 6-308902
Feb. 2, 1995 [JP] Japan ..... 7-016026

[51] Int. Cl.[6] ..... G03G 15/20

[52] U.S. Cl. ..... 399/325; 118/264

[58] Field of Search ..... 355/284, 282, 355/285–290; 219/216; 432/60; 118/258, 264, 259

[56] References Cited

U.S. PATENT DOCUMENTS

| | | | |
|---|---|---|---|
| 4,757,347 | 7/1988 | Tamaoki et al. . | |
| 4,928,148 | 5/1990 | Higashi | 355/290 |
| 5,157,445 | 10/1992 | Shoji et al. | 355/284 |
| 5,157,446 | 10/1992 | Kusaka | 355/285 |
| 5,177,551 | 1/1993 | Arnold | 355/284 |
| 5,232,499 | 8/1993 | Kato et al. | 355/284 X |
| 5,235,394 | 8/1993 | Mills | 355/284 |
| 5,267,004 | 11/1993 | Mills | 355/284 |
| 5,278,617 | 1/1994 | Boisvert et al. | 355/284 |
| 5,285,248 | 2/1994 | Menjo et al. | 355/284 |
| 5,482,552 | 1/1996 | Kikukawa et al. | 355/284 |
| 5,493,376 | 2/1996 | Heeks | 355/284 |
| 5,500,722 | 3/1996 | Jacobs | 355/284 |

OTHER PUBLICATIONS

World Patent Index, Acc. No. 78–11288A, English Abstract of JP–A–52155540, Dec. 24, 1977.

*Primary Examiner*—R. L. Moses
*Attorney, Agent, or Firm*—Jordan B. Bierman; Bierman, Muserlian and Lucas LLP

[57] ABSTRACT

A fixing device includes a fixing member, the surface of which composed of a fluororesin layer, a pressure member which is brought into contact with the surface of the fixing member; a heating member for fusing a toner image on a recording medium, which passes between the fixing member and pressure member, through the fixing member. The device further includes a hollow oil roller for coating toner repellent oil, which is accommodated inside a hollow of the roller, onto the surface of the fixing member. The outer layer of the oil roller is made of a porous layer into which a fluorine-containing surface active agent is impregnated.

8 Claims, 7 Drawing Sheets

TONER IMAGE FIXING DEVICE

BACKGROUND OF THE INVENTION

The present invention relates to a fixing device for use in an electrophotographic image forming apparatus, or similar devices.

Conventionally, a fixing method, which is widely used in an electrophotographic image forming apparatus, or the like, is a pressure-contact thermal-fixing method. In such a method, a recording medium (regular sheet, etc.), on which a toner image to be fixed is carried, is passed between a pair of rollers, at least one of which is heated and which are in pressure contact with each other during rotation, and then pressure-contacted and heated for fixing. In this case, thermoplastic resins, which are primary components for composing toner, are fused and softened, and adhered onto a recording medium, so that the toner image is fixed.

This method has the following excellent properties, in which fixing can be carried out at high speed, the overall size of the device can be reduced, and the possibility of fire is eliminated because the temperature of the thermal roller is only about 20° C., which is a relatively low temperature. However, since toner and the thermo-fixing roller are in pressure contact with each other, some portion of toner adheres to the fixing rollers, that is, so-called offset phenomena tend to occur.

This problem also occurs in the fixing method, which is recently being used for lower speed devices, and in which a toner image is in pressure contact with a heat source through a heat resistive film.

Accordingly, various offset protection technologies are applied to the fixing device recently. Representatives of the above-described technologies are as follows. The surfaces of the fixing rollers are made of fluororesin which has low affinity to fused toner, and releasing agent such as silicone oil, etc., is coated onto the fixing roller.

On the other hand, recent toner improvement has occurred, and the control for molecular weight distribution of resin which is used for toner, and also the development of the releasing agents, contained in the toner, such as low molecular weight polypropylene, etc., have been advanced as disclosed in Japanese Patent Publication Open to Public Inspection Nos. 134652/1975 and 65231/1974.

However, even when these improved technologies are used, the surface release property of the recording medium from the fixing rollers is low during initial operations of the image forming apparatus, or when an image has excessive toner adhered amount on the leading edge of the recording medium, such as in the case of over-all black image, or the like. As a result, the following disadvantages can not be prevented. The recording medium is wound around the fixing roller, or toner adheres to the fixing roller, and the adhered toner is repeatedly transferred onto successive images, resulting in lowered image quality.

Further, requirements of the finished image quality has increased, and specifically, in color images and OHP images (over-head projector), it is required to increase the transparency of the finished image. Accordingly, it is necessary to use so-called sharp-melt resin, having a narrow rubber elastic area, as resin for toner. Therefore, the above-described requirements are disadvantageous for the toner-offset or sheet-winding.

Currently, there is no countermeasure except to increase the amount of silicone oil releasing agents, which is coated on the fixing roller. This countermeasure is insufficient for solving the problems for the following reasons. When the coating amount of the silicone oil is merely increased, the object to improve the releasing property is not always accomplished. Further, in order to liberally continue to coat silicone oil on the roller, it is necessary to provide a large sized fixing device having a large sized silicone oil tank. Still further, the following problems occur. Excessive oil adheres to and remains on the fixed recording medium, the finished image quality is lowered, and sticking occurs. Furthermore, conventionally, silicone rubber is used for the surface material of the fixing rollers. However, in this structure, the releasing property (separation property) of the recording medium from the fixing rollers, is low. Accordingly, oil, such as silicone oil, etc., is coated on the roller surface using an oil supply mechanism.

The present invention is accomplished as follows. In order to develop a fixing device in which the transparency of a formed image is high, the image quality is high, the size is smaller and the mechanism is simpler, there may be a method, in which low viscosity silicone oil (parting oil) is timely supplied in a predetermined amount onto the surface of the roller, without being localized on the surface of the roller.

However, it is difficult to hold low viscosity oil by a simple structure, and to ooze a predetermined amount of oil for a long period of time. For example, the following method, is provided, in which this structure is made non-porous to prevent excessive oozing, and as can be seen in the structure, made of Gore-rex, oozing is carried out by dispersion or penetration. Alternatively, there is another method in which a control layer is used and the diameter of holes provided in the layer is reduced. However, in the consideration of inventors of the present invention, it is difficult to control the oil coating amount, and to prevent oil from oozing at the time of non-use.

The object of the present invention is to solve the foregoing problems, and to provide a fixing device by which the high image quality is obtained on a finished image.

FIG. 7 is a view showing an example of the structure of the conventional device. In FIG. 7, numeral 101 is an upper fixing roller, and numeral 102 is a lower fixing roller. Numeral 103 is a recording sheet, used as a recording medium, which is sandwiched between these fixing rollers 101 and 102, and on which a toner image is fixed. Inside at least one of these rollers 101 or 102, a heating means for fusing the toner (not shown in the drawings) is provided. A toner image 103*a* is formed on the recording sheet 103. Numeral 104 is a guide for guiding the fixed recording sheet 103. Numerals 105 and 106 are sheet delivery rollers for delivering the recording sheet 103 sent through the guide 104.

Numeral 107 is an oil pad for coating, for example, silicone oil or the like, onto the surface of the upper fixing roller 101. Numeral 108 is an equalizing roller to level and equalize the oil coated on the roller surface by the oil pad 107. Numeral 109 is a web type (winding type) cleaning roller to remove toner adhered to the roller surface, which is composed of rollers 109*a*, 109*b* and 109*c*, and a ribbon-shaped cloth 109*d*. Numeral 110 is a fixing separation claw to separate the recording sheet 103 from the upper fixing roller 101 so that the fixed recording sheet 103 is not wound around the upper fixing roller 101 and is not carried therewith. Operations of the thus structured device will be explained below.

The toner image 103*a*, is developed by developing units (not shown) corresponding to an electrostatic latent image formed on a photoreceptor (not shown), is transferred onto the recording sheet 103, and the recording sheet 103 is conveyed to the fixing device by a conveyance mechanism. This toner image 103*a* may be a monochromatic toner image or a color toner image. In the fixing device, the upper fixing roller 101 and the lower fixing roller 102 are rotated in the direction as shown in the drawing.

While the recording sheet 103, sandwiched between the fixing rollers 101 and 102, passes between them, the toner image 103*a* is thermally fused, for example, at about 200° C., and fixed onto the recording sheet 103. In these fixing operations of fixing rollers 101 and 102, for example, silicone oil is continuously supplied to the upper fixing roller 101 by the oil pad 107. Since the oil supplied from the oil pad 107 is usually mottled on the surface of the upper fixing roller 101, the equalizing roller 108 is rotated in the direction shown in the drawing so that the oil is uniformly adhered onto the roller surface.

While the recording sheet 103 passes between the upper fixing roller 101, onto which oil is adhered, and the lower fixing roller 102, since oil is adhered onto the surface of the upper fixing roller 101, it is difficult for toner to adhere onto the surface of upper fixing roller 101. However, since the toner is not completely removed from the roller surface, some toner remains adhering onto the surface of the upper fixing roller 101. Accordingly, any toner remaining on the roller surface is removed by the cleaning roller 109.

When the roller 109*a* is rotated as shown in the drawing and a web 109*d* is wound up, the ribbon-shaped cloth 109*d* is pushed onto the roller surface, and the toner is scraped off. By this operation, any remaining toner adhered onto the surface of the upper fixing roller 101 is removed.

In this connection, when the toner layer formed on the recording sheet 103 is thick, the thermal fusing force is strong and the recording sheet 103 is attracted onto the surface of the upper fixing roller 101. Accordingly, there is a possibility that the recording sheet 103 is carried with the upper fixing roller 101, without separating therefrom. This attraction of the recording sheet onto the roller surface frequently occurs when the solid toner layer is formed on the leading edge of the recording sheet. This phenomena cause jamming.

(Separability of the solid image)

In the case of monochromatic image fixing, because black toner is mainly used, elastic components are high and offset is barely occurs, when toner is fused in the nip portion (a portion which is pressed between the upper fixing roller 101 and the lower fixing roller 102 as indicated by 103*c* in FIG. 9). Even in this case, a document having solid image portions on the leading edge of the recording sheet (refer to FIG. 8) has a large toner amount, and excessively high thermal conductivity, resulting in offset. Accordingly, in order to prevent offset, oil is supplied by an oil supply pad, etc.

In the case of color image fixing, the color reproducibility and glossiness of a transparency sheet are necessary, and it is necessary to form a smooth surface for the toner image after fixing. Therefore, when toner is fused in the nip area, toner viscosity is greatly lowered, and the toner tends to be adhered to the roller. Accordingly, more offset resistivity is required than in monochromatic image fixing. Therefore, a large amount of oil is coated onto the roller. In this case, in order to match the monochromatic image fixing, silicone rubber, which has high affinity to oil, is used for the material of the upper fixing roller. In this case, since the roller material is rubber, durability is limited due to oil swelling, etc.

In order to more easily separate the recording sheet from the roller, a fixing separation claw 110 is brought into contact with the surface of the upper fixing roller 101, and the recording medium 103 is assuredly separated.

In the above example, a fixing device utilizing fixing rollers has been explained. However, there exists a fixing device in which a film sheet is used for fixing. FIG. 10 is a view showing an example of another structure of the conventional fixing device. A low thermal capacity line heater 125, which is fixed to and supported by the device, is made of an alumina base plate 127 on which resistance material is coated, and a current is impressed from both ends. The current flow has a pulse wave-form, and temperature is detected by a temperature sensor 126. The pulse width is changed so that the temperature becomes a predetermined value.

Numeral 124 is a film sheet onto which a toner image, formed on the recording sheet, is fixed. The film sheet 124 is conveyed without wrinkles and slippage due to the drive and tension by a film drive roller 121 and a film driven roller 122. For the film sheet 124, a 10–35 μm heat-resistive film is used. For the material of the film sheet 124, a film is used on which at least 5–15 μm releasing agent layer, which is made by adding a conductive material to fluororesin such as teflon, etc., is coated on, for example, polyester.

A pressure roller 123 with a rubber elastic layer, such as silicone rubber, which has a high releasing property, is operated as follows. The pressure roller 123 presses the recording sheet (not shown) onto the line heater 125 through the film sheet 124, and is rotated in the arrowed direction. The recording sheet, on which the toner image is formed, is passed between the film sheet 124 and the pressure roller 123, is passed through the line heater 125, and is fixed. The fixed recording sheet is separated from the fixing mechanism by the fixing separation claw 128, and is guided to a sheet delivery mechanism, which is not shown.

Also in this film sheet type fixing apparatus, the same oil coating mechanism and the remaining toner removal mechanism, as these shown in FIG. 7, are provided, so that the separability of the recording sheet from the film sheet 124 is improved, and any toner adhered onto the film sheet 124 is removed.

In the above-described conventional fixing apparatus, an equalizing roller is used so that oil adheres uniformly onto the surfaces of the roller and film sheet. Further, in order to remove any remaining toner adhered onto the surface of the fixing roller or the surface of the film sheet, the cleaning roller is used. Accordingly, the structure of the device has become excessively complicated, and the cost of the device is increased. Further, since the recording medium separation claw 110 or 128 is brought into pressure-contact with the surface of the roller or the surface of the film sheet, the edge of the separation claw is worn. Accordingly, the separation claw which loses its separation ability, requires replacement, and causes additional maintenance, which is disadvantageous.

SUMMARY OF THE INVENTION

An object of the present invention is to solve the above-described problems, and to provide a fixing device by which a high-quality image can be fixed and disadvantages described above are solved, and further, in which the mechanism is not complicated, the cost is low, and maintenance is easy.

The object of the present invention can be attained by any of the following structures.

(1) A fixing device comprising: a fixing member, the surface of which is composed of a fluororesin layer; a pressure member which is brought into contact with the surface of the fixing member; a heating member for fusing a toner image on a recording medium, which passes between the fixing member and the pressure member, through the fixing member; and a hollow oil roller for coating a toner separating oil, which is accommodated inside the roller, onto the surface of the fixing member, the fixing device characterized in that the outer layer of the oil roller is made of a porous layer into which a fluorine-containing surface active agent is impregnated.

The fixing apparatus according to the item (1), wherein the fluorine-containing surface active agent is expressed by the following Formula [I],

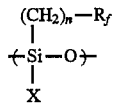

Formula [I]

wherein X represents a saturated hydrocarbon group having 1 to 4 carbon atoms or an aryl group; $R_f$ represents a fluorohydrocarbon group having 2–10 carbon atoms; and n represents an integer of 1 to 4.

(3) The fixing apparatus according to item (1) or item (2), wherein the fixing member is a fixing roller in which the heating member is accommodated.

(4) The fixing device according to item (1) or item (2), the fixing member is a film-like member.

In the present invention, in order to solve the above-described problems, the fluorosilicone system (fluorine-containing system) surface active agent is impregnated into the control layer, and the low viscosity oil such as dimethyl siloxane is contained inside the control layer. By this method, flow of the oil outside the control layer is regulated. In this case, when the impregnated amount of fluorosilicone surface active agent in the control layer is controlled, the low viscosity oil can be uniformly and appropriately coated onto the fixing roller. In this connection, fluorosilicone surface active agent is better than the low viscosity oil because fluorosilicone surface active agent has a lower surface tension than the low viscosity oil.

As shown in FIG. 1, as a specific mechanism to coat the oil onto the fixing device, a low viscosity oil of 100 cs is filled in a hollow pipe 2, whose diameter is approximately 20 mm, having pores 4, whose diameter is less than 1 mm, on the surface of the pipe 2. The outside layer 3 of the hollow pipe is composed of heat resistive silicone foam rubber, into which fluorosilicone surface active agent is impregnated. The thickness of the forming rubber layer is 0.1–1.5 mm, and the impregnation amount is controlled by changing the degree of foaming. The surface tension of the fluorosilicone surface active agent is 15 dyn/cm, which is lower than that of the low viscosity oil contained in the pipe.

Another embodiment of the present invention to solve the foregoing problems, is described as follows. In a fixing device, in which oil coating is carried out using a roller, fluorine-containing silicone oil is used as the oil, the coating amount of the fluorine-containing silicone oil is maintained below $1.4\times10^{-6}$ [cc/cm$^2$], and the roller is used as a cleaning roller and also as an oil coating roller.

In this case, in order to simplify the structure of the fixing device, it is preferable that the above-described roller is used as the oil coating roller and also as the equalization roller.

Further, in order to increase the wear resistance of the fixing roller, it is preferable that a fixing separation claw to separate the recording sheet from the fixing roller or the film sheet, is provided, but is not in contact with the fixing roller or the film sheet.

When fluorine-containing oil is used as the oil to be supplied onto the roller or the film sheet, and its coating amount is maintained below $1.4\times10^{-6}$ [cc/cm$^2$], the separability of toner from the surface of the roller or the film sheet, is increased. Accordingly, the cleaning roller to remove toner is not necessary. That is, only one roller, which serves both as the cleaning roller and as the oil coating roller, is satisfactory, resulting in a simpler structure.

Further, when the fluorine-containing silicone oil is used as oil to be supplied onto the surface of the roller or the film sheet, and its coating amount is maintained below $1.4\times10^{-6}$ [cc/cm$^2$], since the oil is uniformly coated onto the surface of the roller or the film sheet, the equalizing roller, used to equalize the oil coated onto the surface of the roller or film sheet, is not necessary. Further, since the separability of toner from the recording medium is increased, it is not necessary to position the fixing separation claw in contact with the surface of the roller or the film sheet. Accordingly, the wear resistance of the fixing separation claw is increased. Only one roller, which serves both as the equalizing roller and as the oil coating roller, is required, resulting in a simpler structure.

DETAILED DESCRIPTION OF THE PREFERRED EMBODIMENT

The present invention will be explained in detail below. However, the mode of the present invention is not limited to this explanation.

Figure 1:
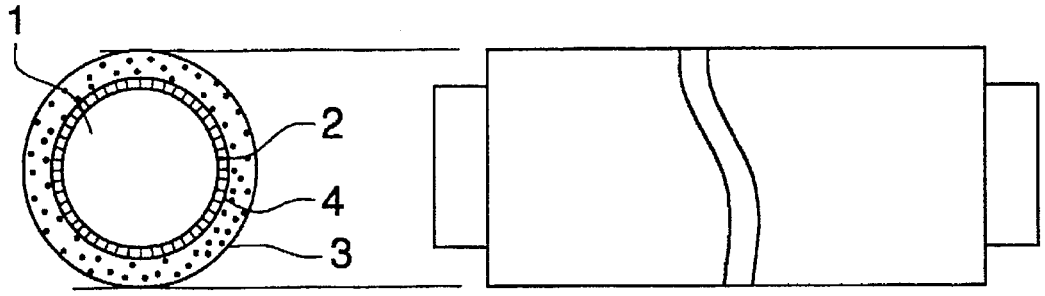
FIG. 1 is a sectional view and a side view of an oil roller according to the present invention.
Figure 2:
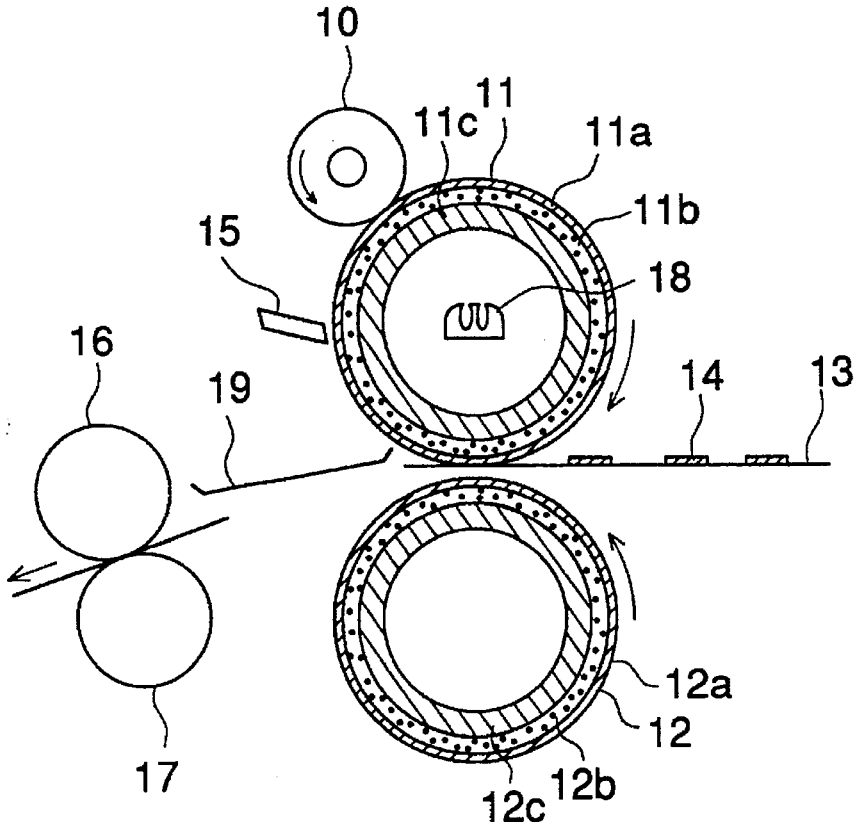
FIG. 2 is a sectional view showing the outline structure of a fixing device of the present invention.

FIG. 2 is a view showing the principle and an example of the structure of a fixing device of the present invention. In FIG. 1, numeral 11 is an upper fixing roller, and numeral 12 is a lower fixing roller which forms a counterpart to the upper fixing roller. In the upper fixing roller 11, numeral 11*a* is a fluororesin layer forming the surface layer of the upper fixing roller 11. Numeral 11*b* is an elastic layer positioned under the fluororesin layer 11*a*, and numeral 11*c* is a core metal which is provided inside the elastic layer 11*b* and serves as the core of the roller. As the fluororesin layer 11*a*, for example, PFA (ethylenetetrafluoriteperfluoroalkoxyethyrene copolymer), for example, is used. PFA resin has a principal chain of polyfluoroethylene and, —OR group (R is perfluoroalkyl group) is linked to a side chain. As a fluororesin material, PTFE (polytetrafluoroethylene), FEP (polyfluoroethylenepropylene copolymer) and others are used in addition to the foregoing. These PFA, PTFE and FEP have characteristics of extremely high durability compared with other kinds of fluororesins.

As a thickness of the fluororesin layer 11*a*, a thickness of about 50 μm, for example, is used. As the elastic layer 11*b* silicone rubber, for example, is used, and its thickness used is 1 mm, for example, and its hardness used is about JIS-A 13°. As the core metal 11*c*, aluminum, for example, is used and as a thickness of the core metal used is about 3 mm, for example. Numeral 18 is a heating means provided inside the upper heating roller 11. As the heating means 8, a halogen lamp heater, for example, is used and its output used is about 850 W, for example, so that the surface of the fixing roller may be heated up to about 200° C.

The lower fixing roller 2 is the same as the upper fixing roller 11 in terms of structure. Namely, in the lower fixing roller 12, numeral 12*a* is a fluororesin layer forming a surface layer of the lower fixing roller 12, numeral 12*b* is an elastic layer positioned under the fluororesin layer 12*a*, and 12*c* is a core metal that is provided inside the elastic layer 12*b* and serves as a core of the roller. As the fluororesin layer 12*a*, PFA, for example, is used, and its thickness used is about 50 μm. As the elastic layer 12*b*, silicone rubber, for example, is used, and its thickness used is 1 mm, for example, and its hardness used is about JIS-A 13°. As the core metal 2*c*, steel, for example, is used and its thickness used is about 3 mm, for example. When the thickness of the elastic layers 11*b* and 12*b* mentioned above is 0.5–5.0 mm, toner images can be fixed uniformly on recording medium 13, which is convenient, because uniform fixing of toner images is necessary for full color fixing that is required for high image quality.

Rollers 11 and 12 mentioned above rotate in the respective directions shown in the figure. Incidentally, the fluororesin layer forming the surface layer on each of the fixing rollers 11 and 12 has only to be provided at least on the roller (upper fixing roller 11) coming into contact with toner images, and the lower fixing roller 12 does not necessarily need to be provided with a fluororesin layer.

Numeral 13 is a recording medium such as a recording sheet and a transparency sheet, and 14 is a toner image formed on recording medium 13. Numeral 10 is an oil-coating roller as a system (means) to coat fluorine-containing silicone oil onto the surface of upper fixing roller 11. This oil-coating means is in the form of a roller, as shown in FIG. 1, and has a system to uniformly coat oil onto the surface of upper fixing roller 11. The oil-coating roller coats the fluorine-coating oil, the surface tension of which is less than 20 dyn/cm, on the surface of the upper fixing roller 11, while its coating amount being maintained to be less than $1.4\times10^{-6}$ cc/cm$^2$. Numerals 16 and 17 represent heat delivery rollers that deliver the recording medium 13 on which an image has been fixed. Numeral 18 is a heating means provided in the upper fixing roller 11. Numeral 19 is a guide that leads the recording medium 3 delivered from the fixing rollers 11 and 12 to the sheet delivery rollers 16 and 17. Movements of an apparatus constituted as in the foregoing will be explained as follows.

A toner image obtained by a developing unit through development of an electrostatic latent image formed on a photoreceptor is transferred onto the recording medium 13 which is conveyed to a fixing unit by a conveyance system, which is not shown in the drawing. This toner image 14 may be either a monochromatic toner image or a color toner image. In the fixing unit, the upper fixing roller 11, the lower fixing roller 12 and the oil coating roller 10 are rotated in the directions shown in the figure.

When the recording medium 13 passes between fixing rollers 11 and 12 while being sandwiched between the fixing rollers 11 and 12, the toner image 14 thereon is subjected to heat-fusion at approximately 200° C. and then is fixed on the recording medium 13. Under such conditions, durability of each of the fixing rollers is higher than that of a silicone rubber roller because the surface layer of the fixing roller is made of a fluororesin layer. In this case, the use of the aforementioned PFA, PTFE or FEP as a fluororesin layer causes the,durability to be extremely high. The recording medium 13 on which images have been fixed is conveyed to the sheet delivery rollers 16 and 17 through guide 9 and then ejected.

In such fixing operations, as stated above, conducted by the fixing rollers 11 and 12, low-viscosity silicone oil (parting oil), such as dimethyl siloxane, is constantly supplied to the upper fixing roller 11 from the oil-coating roller 10. This silicone oil, such as dimethyl siloxane, phenylmethyl siloxane, or diphenyl siloxane, has a low viscosity, and therefore, the entire surface of the upper fixing roller is uniformly coated. Accordingly, the releasability of the recording medium 13 being delivered from fixing rollers 11 and 12, is greatly improved. The viscosity of the low-viscosity parting oil is appropriately 10–200 CS at 25° C.

Figure 3:
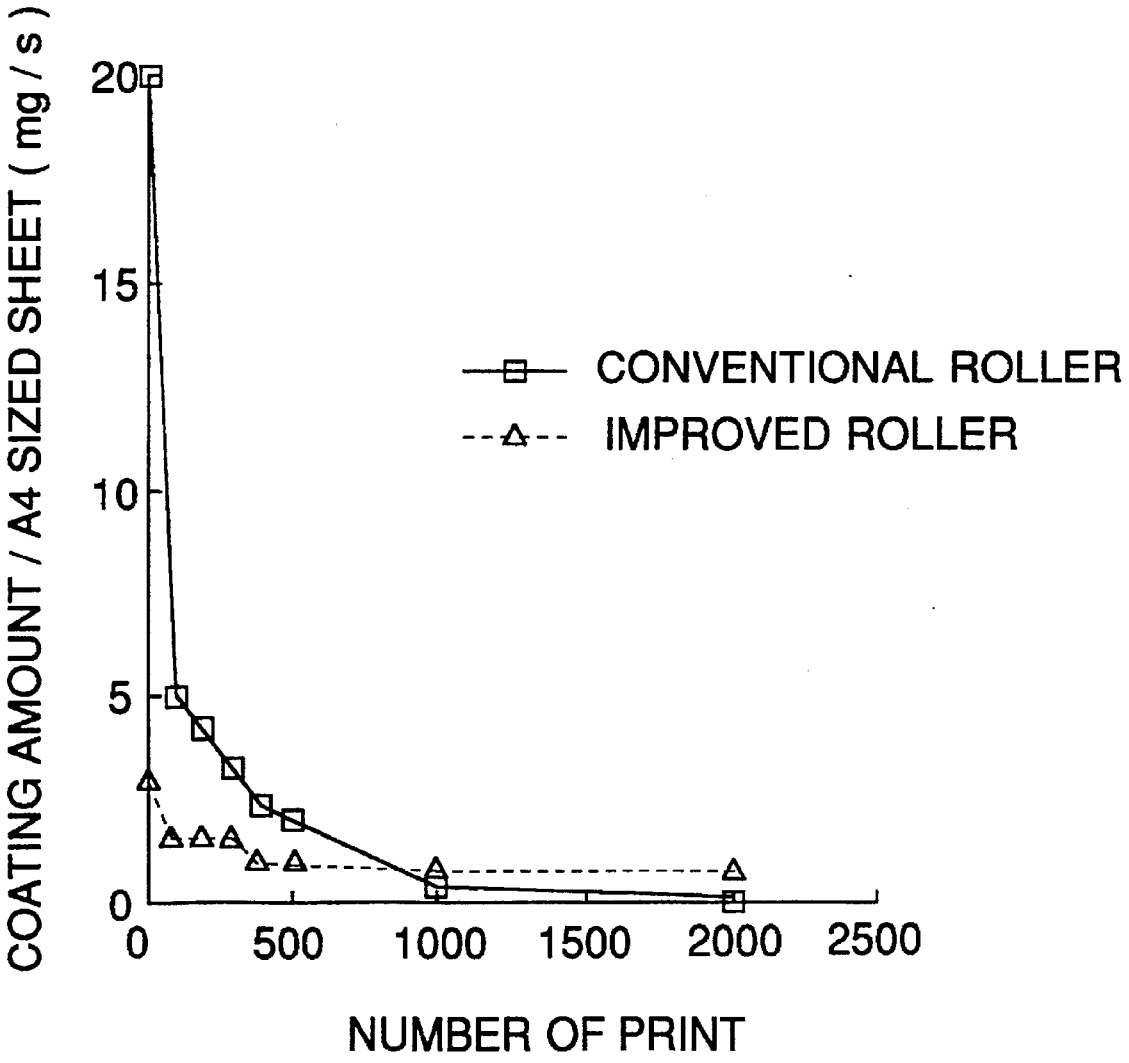
FIG. 3 is a graph showing effects of the fixing device of the present invention.

FIG. 3 is a graph in which the oil coating roller (shown by the dotted line) of the present invention is compared with the conventional oil coating roller (shown by the solid line). The oil-coating roller of the present invention, structured as shown in FIG. 1, has an outer layer of 5 mm thickness into which fluoro-silicone system surface active agent is impregnated from the oil coating layer of the present invention. For comparison, in conventional oil coating rollers, dimethyl siloxane is impregnated in a roller, having the same diameter (25 mm) as that of the oil-coating roller of the present invention and made of silicone-foam rubber.

Due to consideration of the inventors, the following was found. In order to prevent toner offset and winding of the recording medium, it is not always necessary to use a large amount of oil. Inversely, when the coating amount is too much, adhering due to the excessive oil occurs. Here, it is important that an amount of 0.7–0.8 mg per A4 sized recording medium is uniformly and continuously coated. As can clearly be seen from changes of the oil coating amount, as shown in FIG. 3, the following was found. In conventional oil coating rollers, a large amount of oil is coated initially, however, the oil coating amount is rapidly reduced when the number of printing sheets is increased. In this case, in the initial stages of printing, adhering occurs because the oil consumption is excessive, and oil is rapidly consumed when the printing quantity is increased, inversely, resulting in insufficient coating amount.

On the other hand, in the present invention, it can be seen that the initial coating amount is smaller, and a more appropriate amount is supplied over a longer period of time.

An example of a fixing device, in which a fixed low heating value line-shaped heater and a film-shaped member with which a toner image is brought into pressure contact, are used, will be explained below.

Figure 4:
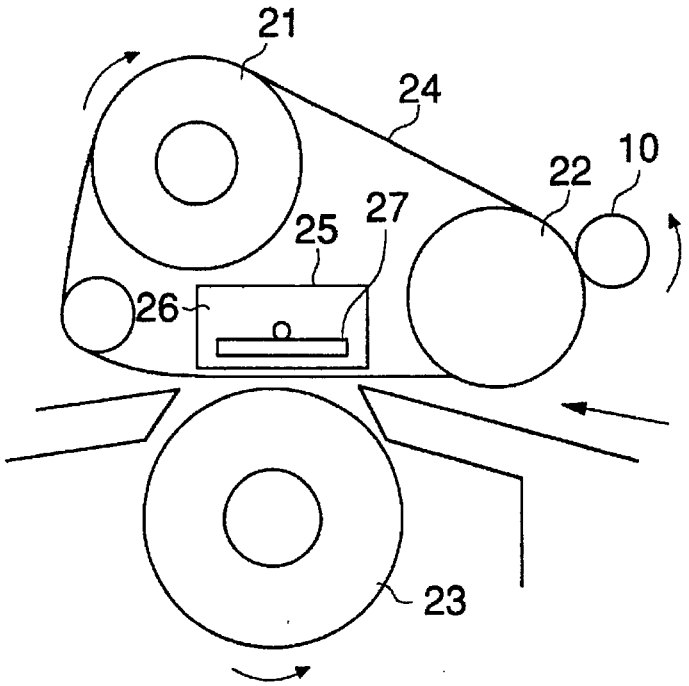
FIG. 4 is a sectional view showing the outline structure of a fixing device of the present invention.

Referring to FIG. 4, a fixing method will be explained below. A low heat content linear heater 25, fixed to and supported by the device, is structured as follows. An aluminum base plate 27, which has the thickness of 0.2–5.0 mm, preferably 0.5–3.5 mm, the width of 10–15 mm, and the length in the longitudinal direction of 240–400 mm, is coated with a resistance material for a 1.0–2.5 mm thickness, and is electrically energized from both ends. The electrical input controlled by a temperature sensor 26, is carried out in a pulse wave of 25 msec. period and DC 100 V in a pulse width varying due to required temperature and energy. The surface temperature T2 of film material 24 directly under the resistant material is lower than temperature T1 detected by temperature sensor 26 in the low heat content linear heater. The temperature T1 is preferably 110° to 220° C., and temperature T2 is preferably 0.5° to 10° C. lower than temperature T1. The temperature T3 of the surface of the film material 24 at the point where the film material is separated from the toner fixing surface is substantially the same as temperature T2. The film material which contacts the energy or temperature controlled heater moves in the same direction as the recording material. The film material 24 is a 10 to 35 μm thick heat resistant film such as polyester, polyperfluoroalkylvinyl ether, polyimide or polyetherimide which is covered with a 5 to 15 μm thick releasing layer containing a conductive material, at least in a fluorine containing resin such as teflon, etc., and the conductive material is preferably an endless belt. The total thickness of the film material is generally 10 to 100 μm.

The film material 24 is transported without crumpling and twisting by means of both the transporting force of the transporting roller 21 and the tension force of a freely moving roller 22. A total pressure of 20 to 300 N is applied by the pressure roller 23, which has an elastic rubber layer of high separability made of, for example, a silicone gum, to contact the film material 24 with the low heat content linear heater 25. The pressure roller 23 rotates in the arrowed direction and passes the toner carrying recording medium between the film material 24 and the pressure roller 23, whereby the toner image is fusibly affixed onto the recording material.

As described in FIG. 2, the oil roller 10 is in pressure-contact with the film material 24 across its width, and is rotated in the arrowed direction, as shown in FIG. 4. In FIG. 4, a small amount of silicon oil is supplied from the oil roller 10 onto the surface of the film material 24 when the film material 24 is in motion. Thereby, the silicone oil coating film of the present invention is formed on the surface on the pressure roller 23 side of the film material 24.

Another example of the fixing method will be explained below, using FIG. 5.

Figure 5:
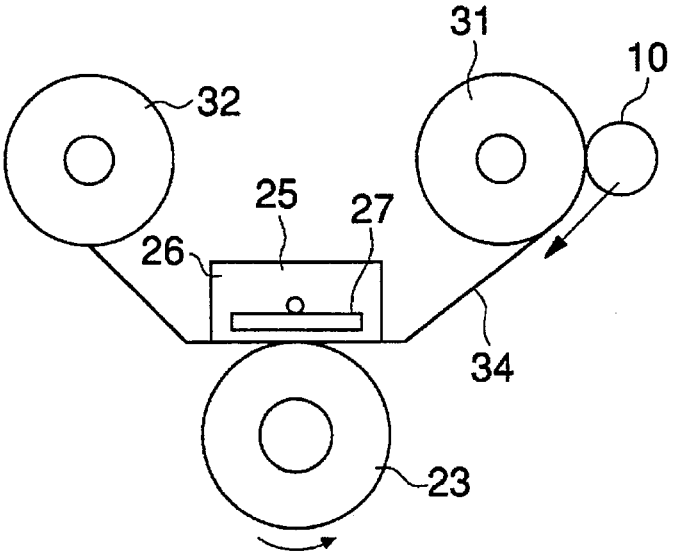
FIG. 5 is a sectional view showing the outline structure of the fixing device of the present invention.

The example of FIG. 5 comprises a non-loop film material having two ends, in contrast to the FIG. 4 example comprising the endless film material.

As shown in FIG. 5, the non-loop film material 34 is wound around a sheet feeding shaft 31 and a sheet winding shaft 32, and moves gradually in the arrowed direction for each fixing operation. In this case, the winding shaft is powered. The numbers 23, 25, 26 and 27 are the same as those denoted in FIG. 4.

The non-loop film material 34, which has been wound around the sheet feeding shaft 31, is gradually rolled around the winding shaft 32 for every fixing process whereby the toner carrying recording material passes between the film material 34 and the pressure roller 23, so that the toner image contacts the low heat content linear heater 15 and is thereby fusibly affixed onto the recording material.

In FIG. 5, the silicone oil impregnated oil roller 10 is in pressure contact with the non-loop film material 34, and a silicone oil coating film is formed on the surface, on the pressure roller side, of the non-loop film material.

The same results as those in FIG. 3 have been obtained also in the results of consideration of the performance of the oil roller using the fixing device shown in FIG. 4. Accordingly, it can be found that the oil roller of the present invention has excellent characteristics also in the fixing method in which a fixed low heat contain linear heater is used.

The silicone oil of the present invention is a fluorine-containing surface active agents silicone oil having a structure unit represented by the following Formula [I],

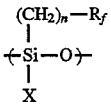

Formula [I]

wherein X represents a saturated hydrocarbon group having 1 to 4 carbon atoms or an aryl group; $R_f$ represents a fluoroalkyl group having 2 to 10 carbon atoms; and n represents an integer of 1 to 4.

In formula (I), X represents an alkyl group having 1 to 4 carbon atoms including a methyl group or an aryl group such as a phenyl group; $R_f$ represents a fluoroalkyl group having 2 to 10 carbon atoms, and preferably 2 to 8 carbon atoms.

$R_f$ more preferably represents a group represented by $Z—(CF_2)_m—$ in which Z represent a hydrogen atom or a fluorine atom, and m represents an integer of 2 to 10, and preferably 2 to 8 as in the above fluoroalkyl group; and n represents an integer of 1 to 4.

It is essential that the fluorine-containing silicone oil of the invention have the above structural unit, but may be a copolymer, further comprising a dimethyl silicone, phenylmethyl silicone or diphenyl silicone structural unit.

It is essential that the fluorine-containing silicone oil of the invention be a liquid having an appropriate viscosity on its usage and an oil having a molecular weight to some degree. Considering the degree of attaining the invention and the oil film-forming property on the fixing roller, when the molecular weight is expressed in a viscosity, the viscosity at 25° C. is 100 to 1,000 centipoise (CS), and preferably 50 to 200 CS in terms of viscosity. The viscosity shows a kinetic viscosity, and is measured by means of a Ubbelohde's viscometer according to ASTM D445-46T or JIS Z8803.

This viscosity can be controlled while adjusting the degree of polymerization during manufacture of the fluorine-containing silicone oil of the invention.

When the fluorine-containing silicone oil of the invention is a copolymer, the silicone oil preferably contains 20 mol % or more of the structure unit represented by Formula (I) in view of the degree of attaining the object of the invention. When the fluorine-containing silicone oil of the invention contains less than 20 mol % of the unit, the degree of attaining the invention deteriorates and properties based on the other structure unit is likely to be conspicuous, so that there sometimes occurs the possibility that the object of the invention can not be attained.

The fluorine-containing silicone oil of the invention is synthesized in the same manner as in any conventional silicone of synthetic method. The dialkyl-substituted dichlorosilane is prepared from silicon and an alkyl chloride, and is hydrolyzed to form a siloxane. Thereafter, the cyclic oligomer or linear oligomer is formed and polymerized to obtain the silicone oil. The fluorine-containing silicone oil of the invention is one having a fluoroalkyl group in the side chain, and synthesized using a fluorine-containing compound having a chloro group at the end instead of an alkylchloride, for example, a compound having a structure represented by the following Formula [II]

$$Z(CF_2)_m(CH_2)_nCl \qquad \text{Formula [II]}$$

wherein Z, m and n represents the same as those denoted in the preferable example of Formula [I].

The typical examples of the compound represented by the following Formula [II] will be shown below.

$CF_3CF_2CH_2Cl$ (A)

$CF_3CF_2CF_2CH_2Cl$ (B)

$CF_3CF_2CF_2(CH_2)_2Cl$ (C)

$CF_3CF_2CF_2CF_2(CH_2)_2Cl$ (D)

$CF_3CF_2CF_2CF_2CF_2CH_2Cl$ (E)

$CF_3CF_2CF_2CF_2CF_2(CH_2)_2Cl$ (F)

$CF_3CF_2CF_2CF_2CF_2CF_2CH_2Cl$ (G)

$CF_3CF_2CF_2CF_2CF_2CF_2CF_2CH_2Cl$ (H)

$HCF_2CF_2CH_2Cl$ (I)

$HCF_2CF_2CF_2CH_2Cl$ (J)

$HCF_2CF_2CF_2(CH_2)_2Cl$ (K)

$HCF_2CF_2CF_2CF_2CH_2Cl$ (L)

$HCF_2CF_2CF_2CF_2(CH_2)_2Cl$ (M)

$HCF_2CF_2CF_2CF_2(CH_2)_4Cl$ (N)

$HCF_2CF_2CF_2CF_2CF_2(CH_2)_2Cl$ (O)

$HCF_2CF_2CF_2CF_2CF_2CF_2CH_2Cl$ (P)

The alkyl chloride for introducing an alkyl group other than a fluoroalkyl group to the oil includes methyl chloride, ethyl chloride, propyl chloride and butyl chloride.

In order to display the desired effect such as uniform coating on the fixing roller covered with a fluorine-containing resin using the fluoroalkyl group substituted silicone oil in the invention, the number of the fluorine atoms is considered to play an important role. The fluorine-containing silicone oil of the invention is a silicone oil having a fluoroalkyl group of 2 to 10 carbon atoms, and preferably 2 to 8 carbon atoms, which are directly bonded through a methylene chain to a silicone atom of the silicone oil.

Typical examples of the fluorine-containing silicone oil will be shown below.

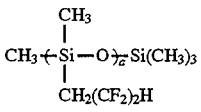
(1) Viscosity:450cs

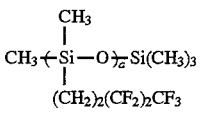
(2) Viscosity:250cs

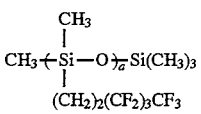
(3) Viscosity:300cs

-continued

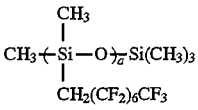
(4) Viscosity:500cs

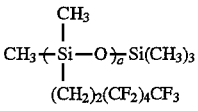
(5) Viscosity:350cs

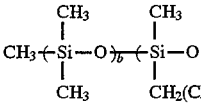
(6) Viscosity:320cs a:b = 80:20

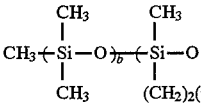
(7) Viscosity:300cs a:b = 60:40

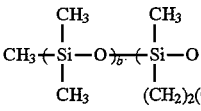
(8) Viscosity:300cs a:b = 70:30

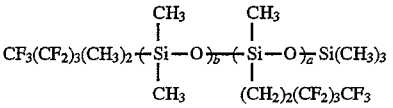
(9) Viscosity:300cs a:b = 80:20

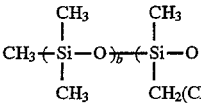
(10) Viscosity:450cs a:b = 50:50

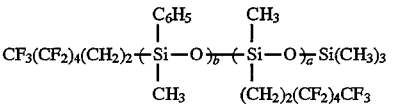
(11) Viscosity:200cs a:b = 30:70

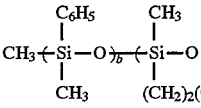
(12) Viscosity:500cs a:b = 90:10

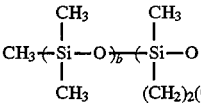
(13) Viscosity:300cs a:b = 80:20

In the above Formula, a and b independently represent an integer of not less than 1, preferably 10 to 1000, and more preferably 20 to 200. The sum of a and b is preferably 40 to 150.

By this invention, a fixing device can be provided, in which: toner offset and undesired winding of a recording medium (transfer sheet, etc.) onto the fixing roller are not caused for a longer period of time than in conventional methods; the finished image is transparent; no adhering occurs; a high quality image is assured; and the mechanism is quite simple.

Another example of a fixing device will be explained below, wherein aspects different from the above-described example are mainly described.

In the fixing device shown in FIG. 2, the upper fixing roller 11, the lower fixing roller 12 and the oil-coating roller 10 are rotated in the direction shown in the drawing. The fluorine-containing silicone oil is coated on the oil-coating roller while maintaining the coating amount of fluorine-containing silicone oil to be less than $1.4\times10^{-6}$ [cc/cm$^2$]. When the coating amount of this fluorine-containing silicone oil is maintained to be less than $1.4\times10^{-6}$ [cc/cm$^2$], the uniform and complete supply of the coating oil onto the surface of the fixing roller is the preferable condition to reduce oil-sticking and any adverse influence on the image, and to increase the life of the coating oil supply mechanism.

Figure 6:
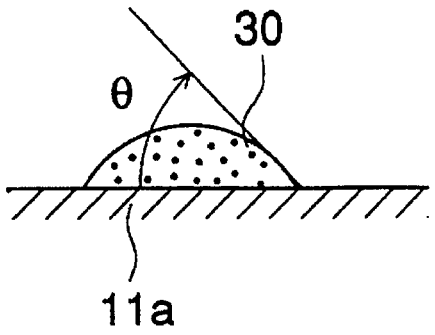
FIGS. 6(*a*) and 6(*b*) are comparative illustrations of the affinity of dimethyl silicone oil and fluorine-containing silicone oil.
Figure 6:
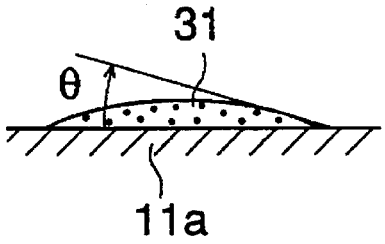

FIGS. 6(*a*) and 6(*b*) show comparison of the affinity between dimethyl silicone oil and fluorine-containing silicone oil. FIG. 6(*a*) shows how dimethyl silicone oil adheres to the surface of a fluororesin layer, while FIG. 6(*b*) shows how fluorine-containing silicone oil adheres to the surface of a fluororesin layer. In the case of dimethyl silicone oil shown in FIG. 6(*a*), the contact angle θ formed between dimethyl silicone oil 30 and a fluororesin layer 11*a* is about 30°–40°, while the contact angle θ formed between fluorine-containing silicone oil 31 and a fluororesin layer 11*a* is 10° or less. A small contact angle means that affinity is high (surface tension is small) and oil tends to spread out over the fluororesin layer 11*a*. This means further that wettability of fluorine-containing silicone oil is higher and thereby a larger area can be coated with the same amount of oil. Accordingly, less amount of fluorine-containing silicone oil is required, resulting in longer life of the coating oil supply mechanism. The surface tension of 20 dyn/cm or less of this fluorine-containing silicone oil is the preferable condition for the high affinity. A coating amount of $1.4\times10^{6}$ [cc/cm$^2$] or less for fluorine-containing silicone oil is the preferable condition for uniformly and entirely supplying coating oil onto the surface of a fixing roller, for reducing an influence of excessive oil on an image, and for lengthening the life of a coating oil supply mechanism.

Figure 7:
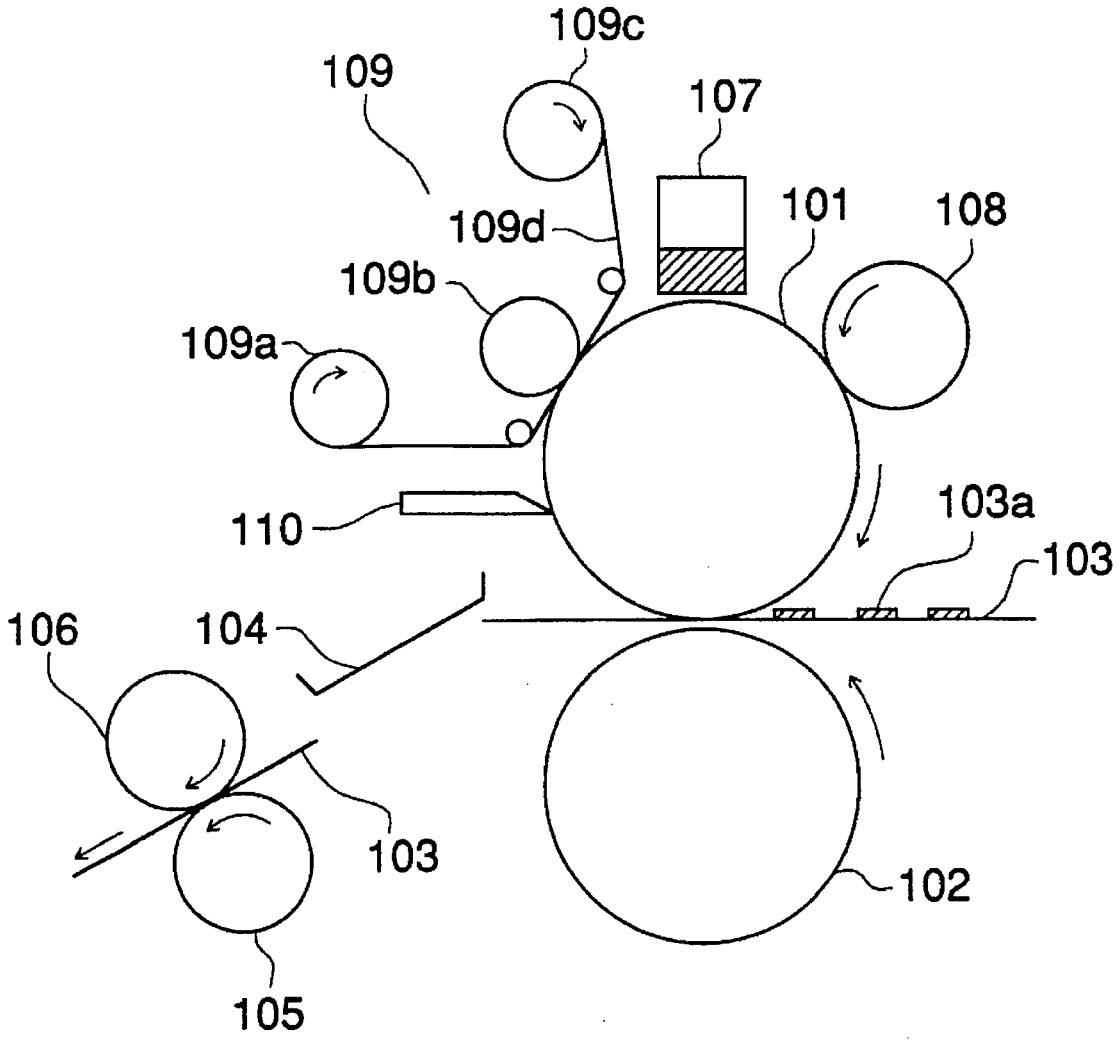
FIG. 7 is a view showing a structural example of a conventional fixing device.
Figure 8:
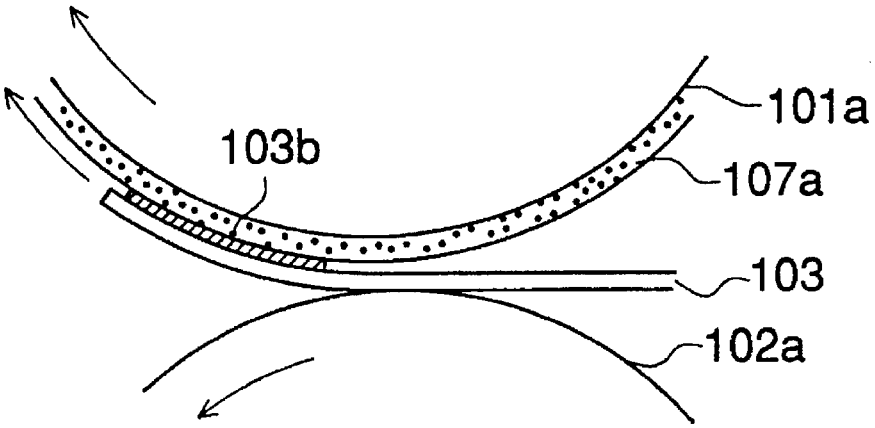
FIG. 8 is a view showing a document which has a solid image portion on the leading edge of the recording sheet.
Figure 9:
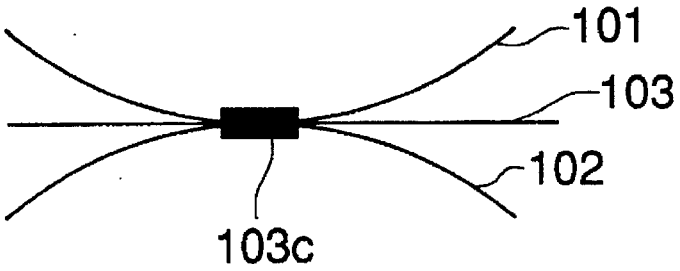
FIG. 9 is an illustration of a nip.
Figure 10:
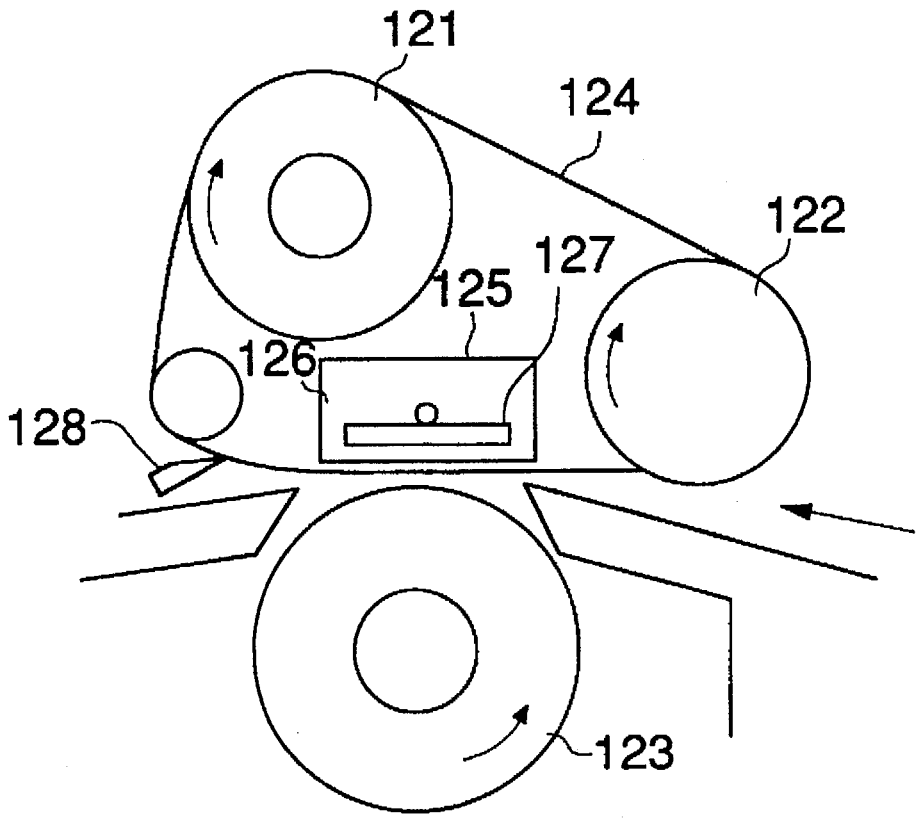
FIG. 10 is a view showing another structural example of a conventional fixing device.

In these fixing operations of fixing rollers 11 and 12, the fluorine-containing silicone oil is continuously supplied onto the upper fixing roller 11 from the oil-coating roller 10. As described above, since this fluorine-containing oil has high affinity with the fluororesin layer 11*a*, the oil is uniformly and completely coated onto the surface of the upper fixing roller 11. Accordingly, an additional equalizing roller 108 to uniformly spread the oil, as shown in FIG. 7, is not necessary. That is, the oil coating roller 10 can serve also as the equalizing roller.

Further, according to the present invention, since the high affinity fluorine-containing silicone oil is uniformly coated onto the surface of the fluororesin layer 11*a*, the releasability (separability) of the toner layer from the fluororesin layer 11*a* is greatly improved when the recording sheet 13 is delivered from fixing rollers 11 and 12. Accordingly, since no toner adheres onto the roller surface, the cleaning roller 109 as shown in FIG. 7 is not necessary. That is, the oil coating roller 10 can also serve as the cleaning roller.

Further, since the separability of the toner layer from the fluororesin layer 11*a* is greatly increased, the recording sheet 13 appropriately rises after the recording sheet 13 has passed the nip. Accordingly, it is not necessary for the fixing separation claw 110 to be brought into contact with the roller surface or the film sheet surface. Therefore, the separation claw 110 can be located while being separated from the surface of the fixing roller or the film sheet surface. Accordingly, the wear resistance of the fixing separation claw 110 is increased. It is preferable that the distance of the separation claw 110 from the roller surface or the film sheet surface be 0.5 mm or more.

In the above example, the case of the fixing device using the fixing rollers is explained as an example. However, the present invention is not limited to this example, but can also be applied to the fixing device using a fixing film sheet in the same manner as described above.

As detailed above, according to the present invention, when a fluorine-containing silicone oil is used as an oil to be supplied onto the roller surface or the film sheet surface, and the coating amount of the oil is maintained lower than $1.4\times10^{-6}$ [cc/cm$^2$], the separability of the roller surface or the film sheet surface from the toner is enhanced. Accordingly, no cleaning roller is necessary for removing the toner. That is, only one roller, used both as the cleaning roller and as the oil coating roller, is required, resulting in a simpler structure.

Further, when a fluorine-containing silicone oil is used as the oil to be supplied onto the roller surface or the film sheet surface, and the coating amount of the oil is maintained lower than $1.4\times10^{-6}$ [cc/cm$^2$], the oil is uniformly coated onto the roller surface or the film sheet surface, an equalizing roller, to uniformly spread the oil onto the roller surface or the film sheet surface, and the oil-coating roller are not necessary. That is, only one roller, used both as the equalizing roller and as the oil-coating roller, is required, resulting in a simpler structure.

Further, when a fluorine-containing silicone oil is used as the oil to be supplied onto the roller surface or the film sheet surface, and the coating amount of the oil is maintained lower than $1.4\times10^{-6}$ [cc/cm$^2$], the separability of the toner from the recording medium is enhanced. Accordingly, it is not necessary for the fixing separation claw to be brought into contact with the roller surface or the film sheet surface, resulting in elimination of wear on the fixing separation claw.

As described above, according to the present invention, a fixing device can be provided, in which: the structure is simple, the cost is low, and maintenance is easy.

What is claimed is:

1. A fixing device comprising:

(a) a fixing member, a surface of which comprises a fluorine containing resin layer;

(b) a pressure member for applying a pressure to the surface of the fixing member;

(c) a heating member for melting a toner image on a recording medium passing between the fixing member and the pressure member; and (d) an oil coating hollow roller storing a toner repellent oil inside a hollow portion thereof for coating the toner repellent oil onto the surface of the fixing member, wherein an outer layer of the oil coating hollow roller is a porous layer impregnated with a fluorine-containing surface active agent, and wherein the toner repellent oil is made of different material than the fluorine-containing surface active agent.

2. The fixing device of claim 1, wherein the fluorine-containing surface active agent is represented by the following formula:

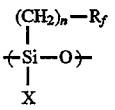

where X represents a saturated hydrocarbon having 1 to 4 carbon atoms or an aryl group, $R_f$ represents a fluoroalkyl group having 2 to 10 carbon atoms, and n represents an integer of 1 to 4.

3. The fixing device of claim 1, the fixing member is a form of roller having the heating member therein.

4. The fixing device of claim 1, the fixing member is a film material.

5. The fixing device of claim 1, wherein the toner repellent oil inside of the oil coating hollow roller is a fluorine-containing silicone oil, a coating amount of the fluorine-containing silicone oil is not more than $1.4\times10^{-6}$ cc/cm$^2$.

6. The fixing device of claim 5, wherein surface tension of the fluorine-containing silicone oil is not more than 20 dyn/cm.

7. The fixing device of claim 4 further comprising a separation claw for separating the recording medium from the fixing roller, wherein the separation claw is provided separate from a surface of the fixing roller.

8. The fixing device of claim 5 further comprising a separation claw for separating the recording medium from the film material, wherein the separation claw is provided separate from a surface of the film material.

* * * * *